US005513912A

United States Patent [19]

Lotz et al.

[11] Patent Number: 5,513,912

[45] Date of Patent: May 7, 1996

[54] STIRRING APPARATUS WITH A HOLDING DEVICE

[75] Inventors: Ekkehard Lotz, Heitersheim; Thomas Hensle, Breisach, both of Germany

[73] Assignee: Janke & Kunkel GmbH & Co. KG IKA-Labortechnik, Staufen, Germany

[21] Appl. No.: 376,135

[22] Filed: Jan. 19, 1995

[30] Foreign Application Priority Data

Jan. 21, 1994 [DE] Germany ..... 44 01 679.4

[51] Int. Cl.[6] ..... B01F 13/04

[52] U.S. Cl. ..... 366/349; 366/601

[58] Field of Search ..... 366/142, 601, 366/349, 219, 232, 208, 209, 207, 206, 205, 215, 211, 197, 249, 241, 251, 282; 73/1 C, 862.31

[56] References Cited

U.S. PATENT DOCUMENTS

| | | | |
|---|---|---|---|
| 1,419,833 | 6/1922 | Fee | 366/142 |
| 2,452,142 | 10/1948 | Pecker | 366/601 |
| 4,318,624 | 3/1982 | Jett | 366/142 |
| 4,332,485 | 6/1982 | Woodman | 366/142 |
| 4,527,904 | 7/1985 | Weetman | 366/349 |
| 4,605,172 | 8/1986 | Ahlert | 366/142 |
| 4,668,096 | 5/1987 | Saaty | 366/142 |
| 4,704,035 | 11/1987 | Kowalczyk | 366/142 |
| 4,753,534 | 6/1988 | Markle | 366/349 |

FOREIGN PATENT DOCUMENTS

| | | | |
|---|---|---|---|
| 1397495 | 3/1965 | France . | |
| 2148620 | 3/1973 | France . | |
| 48234 | 5/1981 | Japan | 366/142 |
| 159897 | 9/1984 | Japan | 366/142 |
| 641973 | 3/1984 | Switzerland . | |
| 1502359 | 8/1989 | U.S.S.R. | 366/142 |
| WO8300101 | 1/1983 | WIPO . | |

OTHER PUBLICATIONS

F. A. Holland et al. (Lever Brothers Company), *Liquid Mixing And Processing in Stirred Tanks*, Reinhold Publishing Corporation, New York, N.Y., pp. 42–49 (1966).

Patent Abstracts of Japan, vol. 11, No. 40 (P–544)(2487), Feb. 5, 1987, (1 sheet) of JP–A–61 209 337.

European Search Report concerning counterpart European Application No. EP 94120498.4 dated Jul. 26, 1995 (2 sheets).

*Primary Examiner*—Timothy F. Simone
*Assistant Examiner*—Tony G. Soohoo
*Attorney, Agent, or Firm*—Panitch Schwarze Jacobs & Nadel

[57] ABSTRACT

A stirring apparatus (1), with a stirring tool and a measurement apparatus (2) for the measurement of torque that is introduced during stirring into the medium that is to be stirred, is mounted on bearings on its holding device (4) in such a way that it can rotate or pivot around the axis of rotation of the stirring tool, and is supported against the direction of rotation of the stirring tool. The measurement of the torque is carried out by means of a measurement value sensor, which records the reaction force of this support directly or indirectly. A measurement value sensor that is fixed in position can be used for the measurement of the torque, and the measurement of the torque requires only a single pivot bearing (11).

21 Claims, 2 Drawing Sheets

STIRRING APPARATUS WITH A HOLDING DEVICE

FIELD OF THE INVENTION

The invention pertains to a stirring apparatus with a holding device and a stirring mechanism which has a drive and a stirring tool. For the measurement of torque introduced to the medium to be stirred, the stirring mechanism is mounted to the holding device in such a way that it can rotate around the axis of rotation of the stirring tool and is supported against the direction of rotation of the stirring tool, while a measurement device records the reaction force of this support.

BACKGROUND OF THE INVENTION

Stirring devices are already known which, by means of torque measurements, make it possible to obtain information concerning the change in viscosity of the medium that is to be stirred (cf. Holland and Chapmam: *Liquid Mixing and Processing in Stirred Tanks*, Reinhold Publishing Corporation, New York, pp. 42–49, 1966). In this regard, for the measurement of the torque there is often provided a torsion measurement shaft which is arranged between the drive shaft of the stirring mechanism and the stirring tool. The torque that is introduced into the medium that is to be stirred then causes a defined twisting of the measurement shaft, which is detected by means of suitable sensor technology.

In this regard, it is particularly disadvantageous that the torsion measurement shaft is connected with the stirring mechanism drive in a fixed fashion, which results in a correspondingly long design of the stirring device, that, in practice, gets in the way most of the time. Since torsion measurement shafts can be loaded with only very slight bending stresses, a correspondingly unwieldy and statically overdefined arrangement of bearings is necessary, which can lead to measurement inaccuracies. In addition, the complex, multiple arrangement of bearings and the difficult measurement of the bending deformation on the turning measurement shaft are linked with a not insignificant cost burden. Furthermore, the torsion measurement shaft can be placed only under a limited torque loading, for which reason the previously known stirring devices are used almost exclusively for measurement purposes.

From CH-PS 641 973, a stirring apparatus is also already known, whose stirring mechanism has a separate housing with two separable housing parts that can be fastened to one another, in conjunction with which the one housing part is provided on the stirring drive and the other on the stirring shaft. To connect the housing parts, the drive shaft of the stirring mechanism has in addition a shaft coupling which in its functional position engages with a mating coupling on the stirring shaft. Between the two housing parts there can be placed an intermediate housing, which has two intermediate housing parts, which can turn in opposite directions by means of a pivot bearing, and one of which is joined to the housing part that is provided on the stirring drive, while the other is joined to the housing part of the stirring mechanism that accommodates the stirring shaft.

In addition, there is provided in the intermediate housing an intermediate shaft, which is placed in an in-line arrangement between the driven shaft and the stirring mechanism shaft, and which is supported in a rotatable fashion in both of the intermediate housing parts. The two housing parts of the stirring mechanism can thus rotates in opposite directions by means of the pivot bearing in the intermediate housing, so that following the fixing of the housing part that is joined with the stirring shaft to a torque support that is joined to the stirring drive in such a way that it cannot turn, the reaction force of the torque that is being introduced into the medium that is to be stirred can be measured.

A disadvantage of this previously known apparatus consists primarily in the fact that it requires a specialized stirring mechanism with a two-piece housing. In the case of stirring mechanisms with a one-piece housing or with a stirring shaft that is uninterrupted and passes all the way through, the intermediate housing is practically unusable. Also unfavorable in addition is the fact that the numerous pivot bearings require a certain expense, and decrease the mechanical stability of the stirring mechanism as well. A further disadvantage consists in the fact that the intermediate housing increases the overall length of the stirring mechanism, which makes it more difficult to handle.

SUMMARY OF THE INVENTION

Therefore, an object of the invention is to create a stirring apparatus of the type mentioned at the beginning, the holding device of which can be combined in a simple manner with any desired stirring mechanism, which makes possible a high degree of measuring accuracy, and which can be manufactured at a reasonable price.

The solution to this object resides in the fact that, for making a separable connection to the stirring mechanism, the holding apparatus has a plug and socket connector into which the stirring mechanism can be inserted in a non-positive (e.g., frictional, gravitational or spring biased) and/or positive (i.e., form fitting) manner.

The apparatus parts that are necessary for the measurement of the torque can thus be connected in a separable fashion with the stirring mechanism, so that these parts can also be subsequently adapted to those stirring mechanisms that are not actually intended for the measurement of torque. As a result of this, even stirring mechanisms of older design can be used for the measurement of torque. By means of the plug-and-socket connection, the stirring mechanism can easily be exchanged as necessary. It is not necessary to take measurement signals from the rotating stirring mechanism shaft. All that is necessary for the rotating bearing arrangement for the stirring mechanism is a single bearing, for example a rolling bearing or possibly a four-point, thin-ring bearing, so that overall, a simple and economical construction design results. In addition, the statically defined bearing arrangement makes possible an especially high degree of measurement accuracy.

In the case of stirring mechanisms with several stirring mechanism shafts or stirring mechanism tools that are rotating in different directions, the measurement apparatus in accordance with the invention can be used only if the sum of all of the torques that are introduced into the medium to be stirred is not equal to zero.

One advantageous embodiment provides that the holding device has one fixed holding part and one pivoting part which can rotate relative to this fixed part and which can be separably connected to the stirring mechanism, and that the measurement apparatus is provided on the holding device. In an advantageous way, the pivoting part is configured as a pivoting plate and the holding part as a holding plate, and a recess is provided between the pivoting plate and the holding plate, specifically in the holding plate, for accommodating the measurement apparatus. As a result, the measurement apparatus is thus especially well protected against mechanical damage and against becoming dirty.

It is especially beneficial if the holding device has an insertion opening arranged coaxially with a pivot bearing for a centering support or similar kind of housing part that is centered with respect to the drive shaft of the stirring mechanism, into which insertion opening the holding device can be inserted from above. As a result of this, upon insertion into the insertion opening, the stirring mechanism is automatically centered with respect to the pivot bearing of the holding device. The measurement accuracy can be increased as a result, since imbalances and other forces acting transversely to the axis of rotation of the stirring tool are supported at the pivot bearing of the holding device, and as a result are not detected by the measurement apparatus.

A helpful embodiment provides that for the insertion of various stirring mechanisms, at least one adapter is provided for the insertion opening and/or the centering support. As a result, the holding device can then be adapted in a simple way to stirring mechanisms of various types, so that even in the case of stirring mechanisms of different designs, one and the same holding device can be used for the measurement of torque.

It is advantageous if the insertion opening is configured as a clamping apparatus with, in particular, a split clamping sleeve, which can be clamped into the centering support or similar kind of housing part that is centered with respect to the drive shaft of the stirring mechanism. The stirring mechanism is then particularly well centered in the insertion opening and cannot tip laterally with respect to the axis of rotation of the holding device. In addition, the stirring mechanism is fixed in position axially so that it cannot be easily loosened from the holding device in the event of an imbalance or in the case of a stirring medium that is not homogenous.

It is especially beneficial if the power supply cable of the stirring mechanism has a strain relief that engages with the holding part or with a part of the holding device that is joined to this holding part in a fixed fashion. As a result, tensile forces on the power supply cable are supported on the fixed holding part and cannot cause on the measurement apparatus any reaction forces that could bring about measurement inaccuracies.

It is especially advantageous if the support is configured for the transfer of the torque in opposite directions. The torque can then be measured even in the case of reversing stirring mechanisms or in the event of differing directions of rotation.

One embodiment provides that the support is configured as a spring. The reaction force can then be converted in a simple way into a corresponding change in length of the spring, in particular, a change in length that is force-travel proportional, and that can be detected by a suitable measured value transducer.

It is beneficial to provide as the measured value transducer a distance measuring device which, for example, records the change in length of the spring, or an encoder that detects the torque-dependent twisting angle of the stirring mechanism or of the stirring container. Commercially available sensors that are based on piezoelectric, inductive, capacitive or optical processes can be used advantageously.

It is especially advantageous, however, if the support is carried out at a flectional beam and if at least one elongation measurement strip is provided for the detection of the bending deformation of the flectional beam. This results in an especially simple and compact design that requires only a very slight, scarcely detectable turning of the stirring mechanism or the stirring container, but allows for a high degree of measurement accuracy in spite of this. In addition, the flectional beam is especially well suited for the supporting of torques in different directions.

It is especially helpful if the flectional beam is clamped in a fixed manner at one end and is supported on a plain bearing at the opposite end. The flectional beam can then be stressed only in bending; the transmission of axial forces, which can cause erroneous data, is not possible.

Advantageously, it is provided that the support of the flectional beam is carried out in a point format or a linear format, in particular, by means of a cylindrical force transfer pin or a force transfer pin with a convex-shaped cap. The plain bearing can then transmit the reaction forces to the flectional beam with particularly little friction.

An advantageous embodiment provides that for the support of the flectional beam, two force transfer pins are provided that engage with side surfaces, which face away from one another, of the flectional beam or a similar kind of support element. As a result of this, it is possible, even in the case of reversing stirring mechanisms, to transmit to the flectional beam the reaction forces of the stirring tool with particularly low friction, so that even in this case a high degree of measurement accuracy can be attained.

An especially simple and economical construction design can be attained by virtue of the fact that the flectional beam is clamped in a fixed fashion to a fixed part, more specifically, to the holding part. The measurement value sensor for the recording of the bending deformation can then likewise be arranged in a fixed fashion, which allows for an especially simple and advantageous routing of the measurement cable.

It is especially beneficial if, for the measurement apparatus, there is provided an overload protection which is configured as a limit stop element that limits the angle of rotation. The areas of application of the stirring apparatus can be significantly expanded as a result, since the maximum permissible torque on the stirring tool is no longer limited by the measurement apparatus. As a result of this, it becomes possible, in particular, to make a robust stirring device with industrial capability, even when using sensitive measurement apparatuses which, for example, allow especially exact measurement of small torques.

Advantageously, it is provided that the support is placed under load by a prestress force. The stirring mechanism or the stirring container can then be reliably supported, even in the case of dynamic loads that can occur, particularly in the event of imbalances in, the stirring tool. In addition, in the case of reversing stirring procedures, the measurement accuracy can be improved at the stationary (turning) point by means of the prestress force. The prestress force must be taken into account during the evaluation of the measured values, for example by subtracting a torque that corresponds to the prestress force.

An advantageous embodiment provides an electronic circuit for processing, filtering, and/or smoothing the measured values. Periodically recurring, brief disturbances in the measured values that are caused, for example by an imbalance in the stirring tool, can be filtered out or smoothed in this way. Slow changes or trends in the measured values which, in particular, make it possible to draw conclusions with regard to changes in viscosity of the medium that is to be stirred, are better able to be detected as a result.

It is beneficial if the measurement apparatus exhibits a display, in particular, a digital display. The torque can then be read by the operator directly from the digital display in Newton-meters or in a percentage relative to a reference value.

For the output of the measured values, an interface can be provided, in particular a digital interface. The stirring apparatus can then be connected to a process computer which determines from the torque, by means of appropriate reference values, the viscosity of the medium to be stirred. In addition, it makes possible a process control in which the stirring process is actively controlled or influenced in dependency on the torque and/or the viscosity of the medium to be stirred.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the partially schematic drawing.

DETAILED DESCRIPTION OF PREFERRED EMBODIMENT

Figure 1:
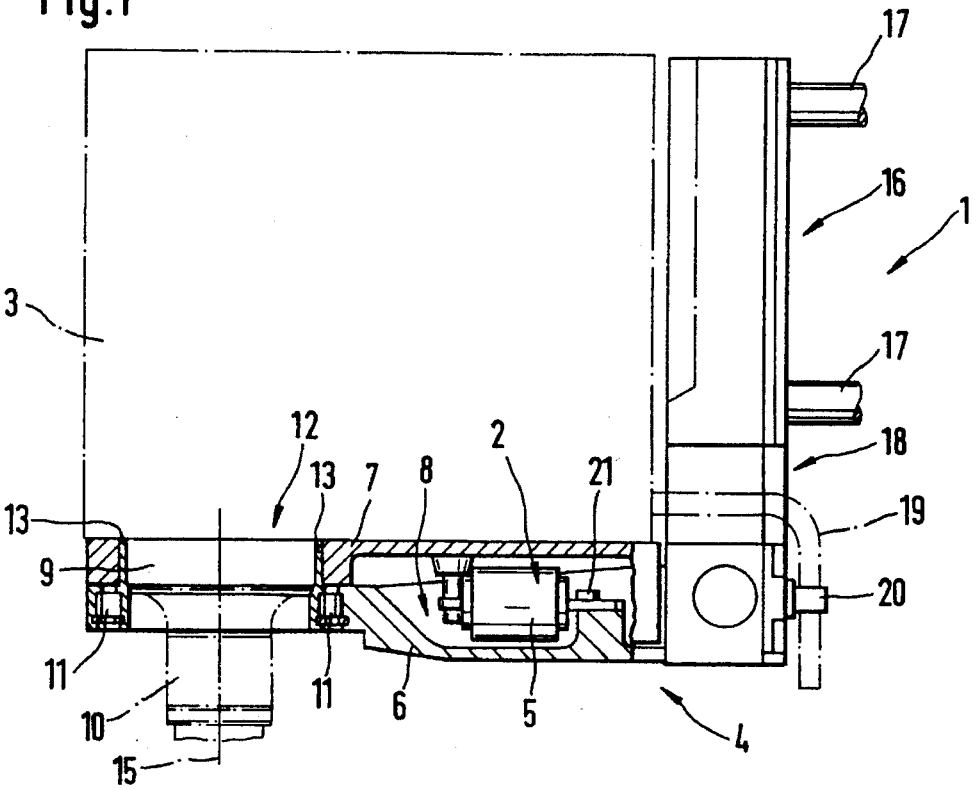
FIG. 1 is a side view, shown partly in section (plane A—A in FIG. 2) of a stirring apparatus with a stirring mechanism having a pivoting bearing arrangement, in conjunction with which a holding device with a pivot bearing or a drag bearing and a flectional beam for the support of the stirring mechanism (shown by dashed lines) is particularly well recognized.

A stirring device, which is designated in its entirety by 1, with a measurement apparatus 2 for the measuring of the torque that is introduced during stirring into the medium to be stirred, has a stirring mechanism 3 which is mounted on bearings on a holding device 4 in such a way that it can rotate or pivot around the rotation axis of the stirring tool, and which is supported in a sprung fashion against the direction of rotation of the stirring tool at a flectional beam 5. The measurement apparatus 2 has on the flectional beam 5 elongation measurement strips which measure the bending deformation that is caused on the flectional beam 5 by the reaction force from the support of the stirring mechanism 3. From this bending deformation, the reaction force is determined, and from the latter is determined the torque that is introduced into the medium to be stirred.

The holding apparatus 4 has a fixed holding part 6 and a pivoting part 7 which is mounted on bearings in such a way that it can rotate with respect to the holding part, and which can be separably attached to the stirring mechanism 3. The holding part 6 and the pivoting part 7 are configured approximately in the shape of plates, and the measurement apparatus 2 is arranged between these two parts in a recess 8 of the holding part 6. As a result, the flectional beam 5 is particularly well protected against mechanical damage and/or becoming dirty. By means of the centering support 9 of the driven shaft 10, the stirring mechanism 3 is non-positively inserted from above into an insertion opening 12 that is arranged coaxially with the pivot bearing 11. The insertion opening 12 is configured as a clamping apparatus with a split clamping sleeve 13, by means of which the centering support 9 of the stirring mechanism 3 can be clamped into place. The clamping sleeve 13 is operated by means of a knurled screw 14 that projects laterally from the holding device 4.

The stirring mechanism 3 is thus separably connected to the holding device 4 in a simple way, so that the holding device 4 can be combined with various stirring mechanisms 3. In order that different stirring mechanism types can also be inserted into the insertion opening 12 in a simple way, and can thus be centered with their drive shaft 10 with respect to the axis of rotation 15 of the pivot bearing 11, suitable adapters for the insertion opening 12 and/or the centering support 9 are provided. As a result, stirring mechanisms 3 of older design which are not actually intended for torque measurement, can be inserted into the holding device 4, and can thus be subsequently expanded by means of an apparatus for the measurement of torque.

Figure 2:
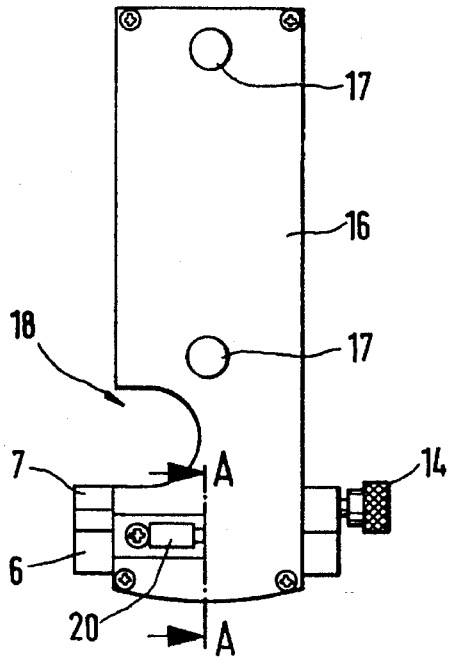
FIG. 2 is a rear view of the holding device in accordance with FIG. 1.

The holding device 4 has on its rear side a carrier plate 16 with at least one, and in the embodiment shown, for the purpose of improved vertical positioning, two support connections 17, by means of which the holding device 4 can be secured to a holding stand or a holding rod. The carrier plate 16 has a plate recess 18 (FIG. 2) that is open to the side for running the power supply cable 19 of the stirring mechanism 3. The plate recess 18 is dimensioned in such a way that the power supply cable 19 cannot come into lateral contact with the carrier plate 16 during pivoting of the stirring mechanism 3. On the rear side of the carrier plate 16 there is provided in addition a strain relief 20 for the power supply cable 19. Tensile forces in the power supply cable 19 are thus supported at the fixed carrier plate 16, and cannot be transmitted to the stirring mechanism 3, which is mounted in a rotating fashion, and thus cause measurement errors. The power supply cable 19 is run between the strain relief 20 and the stirring mechanism 3 spaced from the holding device 4 so that it can move freely during pivoting of the stirring mechanism 3.

Figure 3:
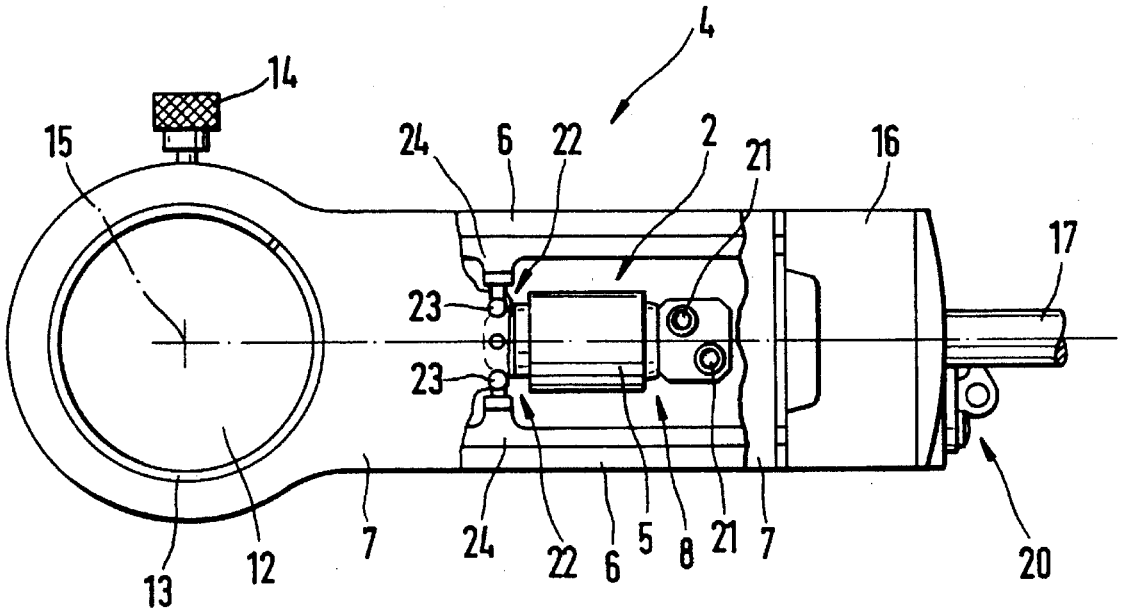
FIG. 3 is a top view of the holding device with measurement apparatus in accordance with FIG. 1, in which the pivoting part is shown open so that the bearing arrangement of the flectional beam can be seen.

The flectional beam 5 is clamped securely at one end to the holding part 6 by means of holding screws 21, and at the other end, it is supported on both sides by plain bearings 22 (FIG. 3). As a result of the clamping of the flectional beam 5 to the holding part 6 that is in a fixed position, an especially simple setup is provided in which even the elongation measurement strips for measuring the bending deformation of the flectional beam 5 are arranged in a fixed position on the holding part 6.

Figure 4:
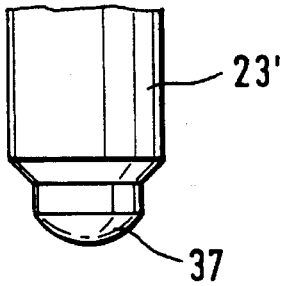
FIG. 4 is a partial side view of the force transfer pin at the plain bearing of the flectional beam which allows the convex pin cap to be seen.

Each of the plain bearings 22 has a cylindrical force transfer pin 23, each of which supports the flectional beam 5 at a flat side surface in a low-friction manner. The low-friction mounting makes possible an especially high degree of measurement accuracy. The force transfer pin 23 can also have a convex-shaped pin cap 37 (FIG. 4). Since plain bearings 22 are provided on both side walls of the flectional beam 5, torques can be supported in opposite directions so that during reversing operation it is possible to measure torque in both directions.

In addition, there is provided on the measurement apparatus 2, on each side of the flectional beam 5 at the holding part 6, a fixed limit-stop element 24 (FIG. 3) that serves as overload protection for the measurement apparatus 2 and limits the angle of rotation or pivoting of the pivoting part 7. In this way, an impermissibly large bending deformation of the flectional beam 5 is prevented.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A stirring apparatus (1) adapted for measurement of torque that is introduced into a medium that is to be stirred comprising a holding device (4) and a stirring mechanism (3) having a stirring mechanism drive and a stirring tool, means for mounting the stirring mechanism to the holding device (4) such that the stirring mechanism drive can rotate around an axis of rotation of the stirring tool, means for supporting the stirring mechanism drive against a direction of rotation of the stirring tool to limit the rotation of the stirring mechanism drive, and a measurement apparatus (2) for recording a reaction force of the supporting means as it limits the rotation of the stirring mechanism drive, the holding device (4) comprising a plug and socket connection adapted to removably receive the stirring mechanism drive (3).

2. The stirring apparatus according to claim 1, wherein the holding device (4) comprises one fixed holding part (6) adapted for connection to a fixed support and one pivoting part (7) which is rotatably mounted to said fixed holding part, the pivoting part being separably connected to the stirring mechanism (3), and the measurement apparatus (2) being provided on the holding device (4).

3. The stirring apparatus according to claim 2, wherein the pivoting part (7) is comprised of a pivoting plate and the holding part (6) is comprised of a holding plate, and further comprising a recess (8) between the pivoting plate and the holding plate for holding the measurement apparatus (2).

4. The stirring apparatus according to claim 2, further comprising a power supply cable (19) for the stirring mechanism (3) and a strain relief (20) for the power supply cable member that engages with the holding part (6).

5. The stirring apparatus according to claim 1, wherein the stirring mechanism drive includes a drive shaft (10) and wherein the holding device (4) has an insertion opening (12) arranged coaxially with a pivot bearing (11) for a centering support (9) centered with respect to the drive shaft (10) of the stirring mechanism drive (3), into which insertion opening the stirring mechanism can be inserted from above.

6. The stirring apparatus according to claim 5, further comprising an adapter device located in the insertion opening (12) such that stirring mechanisms of various sizes can be installed in the insertion opening.

7. The stirring apparatus according to claim 5, wherein the insertion opening (12) comprises a clamping apparatus with a split clamping sleeve (13), into which the centering support (9) can be clamped centered with respect to the drive shaft (10) of the stirring mechanism (3).

8. The stirring apparatus according to claim 1, wherein the supporting means is adapted to prevent rotation of the stirring mechanism drive in either direction.

9. The stirring apparatus according to claim 8, wherein the supporting means comprises a spring.

10. The stirring apparatus according to claim 1, including a measurement value sensor attached to the supporting means for measurement of the reaction force.

11. The stirring apparatus according to claim 1, wherein the supporting means comprises a flectional beam (5) attached to the holding device with at least one elongation measurement strip for detection of a bending deformation of the flectional beam (5) as it limits the rotation of the stirring mechanism drive.

12. The stirring apparatus according to claim 11, wherein the flectional beam (5) is clamped in a fixed manner at one end, and is supported on a plain bearing (22, 22') at the opposite end.

13. The stirring apparatus according to claim 11, wherein the flectional beam (5) contacts a cylindrical force transfer pin (23).

14. The stirring apparatus according to claim 13, wherein two force transfer pins (23, 23') are provided and the two force transfer pins engage with opposite side surfaces of the flectional beam (5).

15. The stirring apparatus according to claim 14, wherein the holding device (4) comprises one fixed holding part (6) adapted for connection to a fixed support and one pivoting part (7) which is rotatably mounted to said fixed holding part, the pivoting part being separably connected to the stirring mechanism drive (3), wherein the flectional beam (5) is attached to the fixed holding part (6).

16. The stirring apparatus according to claim 1, wherein the measurement apparatus (2) includes an overload protection, which is configured as a limit stop element (24) that limits an angle of rotation.

17. The stirring apparatus according to claim 1, wherein the supporting means is placed under load by a prestress force.

18. The stirring apparatus according to claim 1, including an electronic circuit for one of processing, filtering, and smoothing values measured by the measurement apparatus.

19. The stirring apparatus according to claim 18, including a digital interface for output of the measured values.

20. The stirring apparatus according to claim 1, wherein the measurement apparatus (2) includes a digital display.

21. A holding device (4) for measurement of torque that is introduced into a medium that is to be stirred by a stirring mechanism (3) having a stirring mechanism drive and a stirring tool, the holding device (4) comprising:

mounting means adapted for mounting the stirring mechanism drive to the holding device (4) such that the stirring mechanism drive can rotate around an axis of rotation of the stirring tool;

anti-torque means adapted for supporting the stirring mechanism drive against a direction of rotation of the stirring tool to limit the rotation of the stirring mechanism drive;

a measurement apparatus (2) for recording a reaction force of the anti-torque means as it limits the rotation of the stirring mechanism drive; and a plug and socket connection, adapted to removably receive the stirring mechanism drive, into which the stirring mechanism (3) can be inserted.

* * * * *